US011141345B2

(12) United States Patent
Kyriacou et al.

(10) Patent No.: US 11,141,345 B2
(45) **Date of Patent: *Oct. 12, 2021**

(54) PORTABLE ROLLER DEVICE

(71) Applicant: THE MOOVMNT LLC, New York, NY (US)

(72) Inventors: Philippos Kyriacou, Venice, CA (US); Daniel Giordano, Hoboken, NJ (US); Samuel Christopher Jorgenson, New York, NY (US); Alexander Lawrence Georg, Brooklyn, NY (US)

(73) Assignee: The Moovmnt LLC, New York, NY (US)

( * ) Notice: Subject to any disclaimer, the term of this patent is extended or adjusted under 35 U.S.C. 154(b) by 96 days.

This patent is subject to a terminal disclaimer.

(21) Appl. No.: 16/233,515

(22) Filed: Dec. 27, 2018

(65) Prior Publication Data

US 2019/0125621 A1 May 2, 2019

Related U.S. Application Data

(63) Continuation-in-part of application No. 15/779,827, filed as application No. PCT/US2017/019602 on Feb. 27, 2017, now Pat. No. 11,039,976.

(Continued)

(51) Int. Cl.
*A61H 15/00* (2006.01)
*A61H 1/00* (2006.01)

(52) U.S. Cl.
CPC ..... *A61H 15/00* (2013.01); *A61H 1/00* (2013.01); *A61H 2015/0014* (2013.01);

(Continued)

(58) Field of Classification Search
CPC ..... A61H 15/00; A61H 15/092; A61H 2015/0007; A61H 2015/0014;

(Continued)

(56) References Cited

U.S. PATENT DOCUMENTS 3,713,455 A 1/1973 Chen et al.
4,191,177 A * 3/1980 Abbott ..... A61H 1/00 601/125

(Continued)

FOREIGN PATENT DOCUMENTS

CN 2792481 Y 7/2006
CN 2937022 Y 8/2007

(Continued)

OTHER PUBLICATIONS

Extended European Search Report dated Oct. 21, 2019; EPO Appl. No. 17760525.0; pp. 1-8.

(Continued)

*Primary Examiner* — Justine R Yu
*Assistant Examiner* — Matthew D Ziegler
(74) *Attorney, Agent, or Firm* — FisherBroyles LLP; Kevin D. Jablonski

(57) ABSTRACT

An improved roller device includes a plurality of segments, wherein the plurality of segments is configured to form a tubular shape. In addition each of the plurality of segments are coupled to neighboring segments of the plurality of segments and each of the plurality of segments include a first edge and a second edge, wherein the first edge is opposite the second edge. Each segment includes a plurality of protrusions on each respective edge for interfacing with a respective complementary edge with complementary protrusions of a neighboring segment. The roller device also includes a coupling mechanism for coupling the first edge of a segment to a second edge of a first neighboring segment and coupling the second edge of the segment to a first edge of a second neighboring segment, wherein the coupling mechanism allows the plurality of segments to convert from a first position to a second position.

8 Claims, 12 Drawing Sheets

Related U.S. Application Data

(60) Provisional application No. 62/301,095, filed on Feb. 29, 2016.

(52) U.S. Cl.
CPC ..... *A61H 2201/0107* (2013.01); *A61H 2201/0157* (2013.01); *A61H 2201/0161* (2013.01); *A61H 2201/1284* (2013.01); *A61H 2201/169* (2013.01); *A61H 2201/1654* (2013.01); *A61H 2201/1695* (2013.01); *A61H 2205/06* (2013.01); *A61H 2205/081* (2013.01); *A61H 2205/10* (2013.01)

(58) Field of Classification Search
CPC .... A61H 2201/0107; A61H 2201/0157; A61H 2201/0161; A61H 2201/1253; A61H 2201/1261; A61H 2201/1284; A61H 2201/1683; A61H 2201/1685; A61H 2201/169; A61H 2201/1695; A61H 1/006; A61H 1/008; A63B 22/20; A63B 22/201; A63B 2210/50; A45C 7/0095
See application file for complete search history.

(56) References Cited

U.S. PATENT DOCUMENTS

| | | | | |
|---|---|---|---|---|
| D257,595 | S | 12/1980 | Bullock | |
| 5,143,056 | A | 9/1992 | Yih-Jong | |
| 5,389,063 | A * | 2/1995 | Wu | A61H 7/001 273/153 S |
| 5,572,757 | A | 11/1996 | O'Sullivan | |
| D457,268 | S | 5/2002 | Kwong | |
| D467,386 | S | 12/2002 | Carlucci et al. | |
| 6,564,960 | B1 | 5/2003 | Grindstaff et al. | |
| D573,262 | S | 7/2008 | Soucy | |
| D637,244 | S | 5/2011 | Davis et al. | |
| D657,830 | S | 4/2012 | Guarrasi | |
| D660,450 | S | 5/2012 | Johnson | |
| D693,934 | S | 11/2013 | Lin | |
| D700,346 | S | 2/2014 | Palizzi et al. | |
| D713,050 | S | 9/2014 | Kao | |
| D737,456 | S | 8/2015 | McDonough et al. | |
| 9,186,003 | B2 | 11/2015 | Hsu | |
| 9,301,900 | B2 | 4/2016 | Johnston | |
| D755,304 | S | 5/2016 | Ackerman | |
| D785,103 | S | 4/2017 | Townsend | |
| D788,313 | S | 5/2017 | Lawrie | |
| 9,839,574 | B2 * | 12/2017 | Lawrie | A61H 15/00 |
| 9,855,185 | B2 | 1/2018 | Chen | |
| D825,695 | S | 8/2018 | Kim | |
| D842,486 | S | 3/2019 | Kaoru | |
| 2009/0131234 | A1 | 5/2009 | Dye | |
| 2011/0300995 | A1 | 12/2011 | Castiglione | |
| 2012/0035029 | A1 | 2/2012 | Dye | |
| 2012/0277077 | A1 | 11/2012 | Hsu et al. | |
| 2013/0096472 | A1 | 4/2013 | Bertram et al. | |
| 2015/0110896 | A1 | 4/2015 | Davis | |
| 2015/0133837 | A1 | 5/2015 | Crowell et al. | |
| 2015/0190304 | A1 | 7/2015 | Lawrie | |
| 2015/0209220 | A1 | 7/2015 | Lin | |
| 2015/0265486 | A1 | 9/2015 | Fiore | |
| 2016/0008692 | A1 | 1/2016 | Townsend | |
| 2016/0331628 | A1 | 11/2016 | Kuo | |
| 2017/0189261 | A1 | 7/2017 | Chen | |
| 2017/0258661 | A1 | 9/2017 | Bradford | |

FOREIGN PATENT DOCUMENTS

| | | | |
|---|---|---|---|
| CN | 201019993 | Y | 2/2008 |
| CN | 201583804 | U | 9/2010 |
| CN | 104706512 | A | 6/2015 |
| GB | 2502112 | A | 11/2013 |
| WO | 2015105913 | A1 | 7/2015 |
| WO | 2016153551 | A1 | 9/2016 |

OTHER PUBLICATIONS

International Search Report & Written Opinion dated May 19, 2017; PCT Application No. PCT/US2017/019602; filed Feb. 27, 2017; pp. 1-8.

* cited by examiner

PORTABLE ROLLER DEVICE

CONTINUATION-IN-PART PRIORITY CLAIM TO UNITED STATES PATENT APPLICATION

This application is a Continuation-in Part (CIP) application that claims the priority filing date benefit of U.S. National stage patent application Ser. No. 15/779,827 entitled "PORTABLE ROLLER DEVICE," filed May 29, 2018 which, in turn, claims priority filing date benefit of PCT Application No. PCT/US17/19602, entitled "PORTABLE ROLLER DEVICE," filed Feb. 27, 2017, which, in turn, claims priority filing date benefit of U.S. Provisional Patent Application No. 62/301,095, entitled "PORTABLE ROLLER DEVICE," filed Feb. 29, 2016, each of which is incorporated by reference in its entirety herein for all purposes.

BACKGROUND

The present disclosure relates generally to exercise and therapy equipment and, more particularly, to a portable roller device.

Roller devices can provide desirable physiological benefits in physical therapy and general fitness activities, such as exercise, and stretching activities. Roller devices enable individuals to target troubled muscle areas using their own body weight to massage away restrictions of their muscles. Additionally, roller devices allow individuals to exercise and perform self-myofascial release therapy without the need to visit a therapist or trainer for each session.

Roller devices have not only become an essential device for rehabilitation and training but have also become more common for personal home and office use. Users may be reluctant to purchase roller devices for personal use because of the burden of having to store the equipment if storage space in an office or at home is limited. In addition, individuals undergoing therapy may need to travel for business or may have vacations planned during a period when a therapy session is scheduled. In addition, often times athletes travel to various venues to participate in sporting events. While traveling the availability of space must be taken into consideration whether checking bags with an airline or storing items in the trunk of an automobile. Conventional roller devices are generally inflexible and take up large amounts of space. The problem of space limitations can be compounded if a team trainer or therapist needs to transport multiple roller devices for training multiple athletes or clients at a remote site. For all of these reasons storage and transportation of the roller devices can become problematic.

Traveling trainers and clients greatly prefer to have uninterrupted exercise and/or therapy regimens. Those faced with limited storage issues should not be deterred from continuing their exercise or therapy routines due to the inconvenience of storing and/or transporting bulky roller devices. It is therefore desirable to provide a roller device capable of being conveniently transformed from a configuration for storage and transportation to a configuration for use in therapy and exercise.

BRIEF DESCRIPTION OF THE DRAWINGS

Aspects and many of the attendant advantages of the claims will become more readily appreciated as the same become better understood by reference to the following detailed description, when taken in conjunction with the accompanying drawings, wherein:

DETAILED DESCRIPTION

Figure 1:
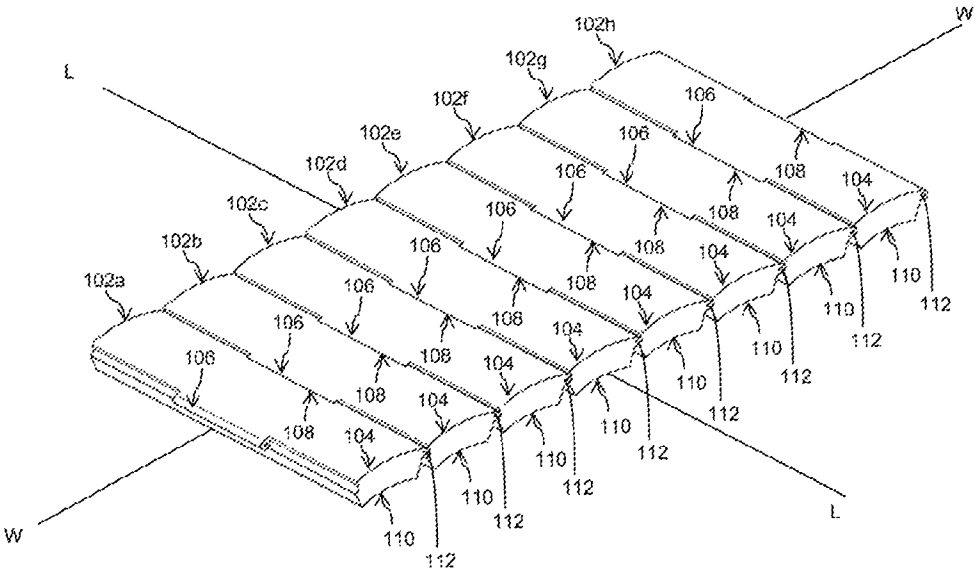
FIG. 1 illustrates a roller device according to an embodiment of the subject matter disclosed herein.

The following discussion is presented to enable a person skilled in the art to make and use the subject matter disclosed herein. The general principles described herein may be applied to embodiments and applications other than those detailed above without departing from the spirit and scope of the present detailed description. The present disclosure is not intended to be limited to the embodiments shown, but is to be accorded the widest scope consistent with the principles and features disclosed or suggested herein.

The subject matter disclosed herein is directed to an improved portable roller device. The improved portable roller device includes a core layer, where the core layer includes an outer surface, an inner surface, a first core layer edge, and a second core layer edge, and a coupling mechanism, where the coupling mechanism being configured to secure the first edge and second edge of the core layer to form a tubular construct that may be suitable for use as a rolling massage therapy device. The roller improved roller device can further include the core layer having a plurality of segments, where each segment of the plurality of segments includes a first edge, a second edge, an outer surface and an inner surface, where the first edge is opposite the second edge. Each of the plurality of segments may be disposed adjacent to a first neighboring segment and a second neighboring segment, such that each segment includes a plurality of interlocking protrusions on each respective edge Thus, each segment protrusion connects one of the plurality of segments to one or more of the other plurality of the segments.

In accordance with an embodiment of the present disclosure, a roller device and a method of converting a roller device are provided. The method includes coupling a plurality of segments of the roller device, wherein the plurality of segments are configured to form a tubular shape, wherein each of the plurality of segments are coupled to neighboring segments of the plurality of segments, wherein each of the plurality of segments comprise a first edge and a second edge, wherein the first edge is opposite the second edge. The method also includes a coupling mechanism for coupling the first edge of a segment to a second edge of a first neighboring segment and coupling the second edge of the segment to a first edge of a second neighboring segment. The method includes converting the roller device from a first position to a second position and locking the plurality of segments.

In accordance with another embodiment, a method for relieving muscle tension is provided. The method includes providing a roller device. The roller device includes a plurality of segments, wherein each of the plurality of segments comprise a first edge, a second edge, an outer surface and an inner surface, wherein the first edge is opposite the second edge, the plurality of segments further comprising a first neighboring segment and a second neighboring segment. The device also includes a plurality of segment connectors, each segment connector connecting one of the plurality of segments to one or more of the other plurality of the segments. The device also includes a coupling mechanism connected to the first neighboring segment and the second neighboring segment. The method also includes applying the roller device to an area of a body. The method also includes rolling the device across that area of the body.

In accordance with embodiments of the disclosure, a roller device and a method for converting a roller device are provided. An object of the present disclosure is to provide a roller device that is capable of converting from a first flat position to a second rigid or semi-rigid tubular position. Another object of the disclosure is to improve the storage and portability of the roller device without sacrificing the operability of the device to function as a roller device. The roller device is capable of maintaining its tubular position through rotational forces when being used by a client. The structure of the roller device can be created from a single component or multiple components formed of plastic, metal or other rigid materials. This rigid structure can be the roller in whole or a base structure supporting a layer of material offering a different durometers or ability to be compressed. The rigid structure can also incorporate the hinge or hinge like mechanisms.

In an embodiment, the roller device includes a single flexible material that is capable of lying flat and converting into a rigid tubular position. In an exemplary embodiment, the roller device comprises a plurality of segments. In some embodiments, each of the plurality of segments can be connected to one or more neighboring segments, such as two neighboring segments. For example, a segment can be connected to a neighboring segment on a first side and connected to a further neighboring segment on a second side, wherein the second side is opposite the first side. In some embodiments, one or more segments can have a defined arc that can allow the plurality of segments to form a tubular shape when connected together, while in other embodiments the plurality of segments can have a flat surface. When connected to one another the plurality of segments being parallel to one another lie in a horizontal plane in a flat position for transport and storage. Additionally, the plurality of segments can be formed into a tubular shape. In some embodiments, the tubular shape is a cylinder. In some embodiments, the tubular shape is a polygon, such as a pentagon, hexagon, heptagon, octagon, nonagon, or decagon. When configured in the tubular position the plurality of segments form an outer surface which provides a surface to treat the user's body during rolling. In some embodiments when the plurality of segments are connected an inner cavity is formed.

Now referring to FIG. 1, a roller device 100 is shown. The roller device 100 is shown in a first flat position. In the first flat position, the plurality of segments lie connected to one another in a parallel fashion in a horizontal plane. In some embodiments, the roller device is rectangular in shape when in a first flat position. As a non-limiting example, the rectangle can have a width W of 5 to 40 inches, or 5 to 30 inches, or 10 to 30 inches, or 10 to 20 inches, or 10 to 15 inches, or 14 inches. In some embodiments, the rectangle can have a length L of 5 to 40 inches, or 5 to 30 inches, or 10 to 30 inches, or 10 to 20 inches, or 10 to 15 inches, or 11.5 inches, and a thickness or height of 0.5 to 3 inches, or 1 to 3 inches, or 1 to 2 inches, or 1.7 inches. The first flat position can be convenient for storage and/or transportation of the device. In another embodiment, the roller device can be formed by a single flexible, semi-rigid material. The roller device can include a plurality of segments numbered, 102*a*, 102*b* . . . 102*h* forming a core layer or base layer of the device, where each of the plurality of segments has an inner surface 110 and an outer surface 104, and where n represents the total number of segments in the device and is an integer from 1 to 100. In an embodiment, the outer surface 110 can have a flat or curved surface and the inner surface 110 can have a flat or curved surface. In a non-limiting example, FIG. 1 depicts an exemplary roller device 100 having 8 segments. In some embodiments, the roller device has from 5 to 50 segments, such as 5 to 20 segments, or from 5 to 10 segments. Preferably, the device has from 5 to 10 segments. The outer surface 104 of each segment 102 provides a surface that makes contact with a user's muscles or target area during use. In an exemplary embodiment, the outer surface 104 as shown in FIG. 1 can have a smooth surface. In another embodiment, the outer surface 104 can have a textured/patterned surface. Additionally, the outer surface 104 may have various densities which may be selected according to a selected level of treatment, comfort, or therapy. The plurality of segments 102 can be composed of a low density material, medium density material, high density material or any combination thereof offering various resistances to the user. The low density materials can provide a softer surface for the user and the high density materials can provide a firmer surface. The medium density material can be a compromise between the low and high density options. Non-limiting examples of foam materials include EVA (ethylene vinyl acetate) foam, urethane foam, poly-urethane foam, EPS (expanded polystyrene) foam, polyethylene foam, neoprene foam, and the like. Additionally, the foam materials can comprise open cell and closed cell configurations.

Each of the plurality of segments 102 include a first edge 106 and a second edge 108 where the first edge 106 is located opposite the second edge 108. FIG. 1 depicts the first edge 106 of segment 102*b* can be coupled to a second edge 108 of a first neighboring segment 102*a* and the second edge of 102*b* can be coupled to a first edge 106 of a second neighboring segment 102*c*. Similarly, the first edge 106 and second edge 108 of segment 102*d* can be coupled to the second edge 108 of segment 102*c* and the first edge 106 of segment 102*e* respectively. In some embodiments, the first edge of a segment can complement the second edge of a neighboring segment allowing the plurality of segments to be coupled to one another and form the roller device. Complementary edges of neighboring segments are configured to be inserted into one another, such as a female receiving component and a male extension component complement one another.

FIG. 1 further depicts the plurality of segments 102*a*-102*h* is coupled to neighboring segments where each of the plurality of segments 102*a*-102*h* are coupled to the neighboring segments at a distal edge 114, where the distal edge 114 is located on the outer surface 104. A coupling mechanism can be any mechanism that joins the neighboring segments in a manner that allows the segments to move relative to one another. In one embodiment the coupling mechanism 112 is a single hinge device secured by a single structural pin. As such, the embodiment of FIG. 1 may be described as having one segment with a single protrusion at the distal edge that interfaces with a neighboring segment having two protrusions that envelop the one protrusion on the initial segment. This segment coupling mechanism can allow the plurality of segments to maintain their ability to pivot around the coupling mechanism and convert between a first flat position and a second tubular position. As will be described below, other embodiments may include a plurality of protrusions on each segment distal edge for interfacing with neighboring segments along with multiple pins.

In an exemplary embodiment, a locking segment ("not shown") may be used to allow the device to secure the roller device into position and maintain the rigid tubular position for when ready for use. In an exemplary embodiment, the locking segment may have the same structure as the coupling mechanism of the other plurality of segments. In other embodiments, the locking segment may have a different mechanism for securing and releasing the roller device. These mechanisms can include a hinge mechanism, and further include Velcro, zippers, magnets, push-buttons, compression couplings, dovetail joints, and the like. In an exemplary embodiment, the locking mechanism may be located on the side of the roller device or may further be actuated by a push button or other release mechanism.

In an exemplary embodiment, the exercise roller device 100, as shown in FIG. 1 includes the coupling mechanism 112 having a structural pin in combination with a first edge of a segment coupled to a second edge of a neighboring segment, where the structural pin is threaded through a portion of the first edge and a portion of the second edge. This exemplary configuration can allow the plurality of segments to be secured to one another during compressive force or pivot and separate with an outward radial force when the coupling mechanism 112 is released.

Other coupling mechanisms can be used, including a configuration that does not require structural pins to secure the plurality of segments, while maintaining each segment's mobility. In some embodiments, a plurality of segments may be able to snap into position and maintain its mobility while forming the rigid tubular shape. For example, the first edge of a segment can snap into a second complimentary edge of a neighboring segment. In other embodiments the coupling mechanisms include Velcro attachments, zipper attachments, button attachments, magnetic attachments, hook type attachments, and the like.

In some embodiments, the roller device includes only one flexible, semi-rigid segment having a coupling mechanism for forming and maintaining the roller device. For example, a single continuous material capable of lying flat in a horizontal plane and converting into a tubular shape is within the scope of the disclosure.

Figure 2:
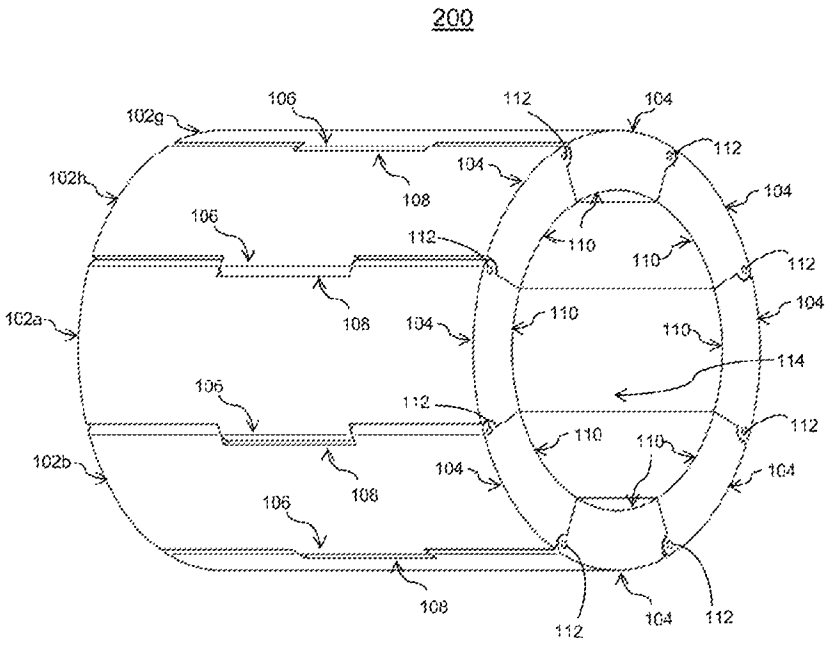
FIG. 2 illustrates an alternate view of the roller device of FIG. 1 according to an embodiment of the subject matter disclosed herein.

FIG. 2 illustrates a second configuration of the roller device 200 of FIG. 1, where the plurality of segments 102*a*-102*h* can be connected to form a tubular shape. Each of the plurality of segments 102*a*-102*h* can be secured by the coupling mechanisms 112 joining the first edge 106 of a segment to a second edge of a neighboring segment. The second configuration is formed when the plurality of segments 102*a*-102*h* is coupled and the first segment 102*a* and last segment 102*h* of the plurality of segments are connected forming a rigid tubular structure. The plurality of segments 102*a*-102*h* form an inner cavity 114 when in the second configuration. In a different embodiment, a single flexible, semi-rigid material having a coupling mechanism can be converted into the second configuration and form an inner cavity. In an exemplary embodiment, the inner cavity 114 can be tubular, cylindrical, or polygonal in shape. The coupling mechanism can allow each of the plurality of segments to pivot around the coupling mechanism 112 to convert from a first flat position shown in FIG. 1 to the second tubular shape position as shown in FIG. 2. When the exercise or therapy session is completed at least one of the plurality of segments 102*a*-102*h* can be disconnected and the roller device is returned to the first position shown in FIG. 1 for storage/transport. In an exemplary embodiment, the user can engage and disengage the coupling mechanism to convert the roller device from a first configuration for storage to the second configuration for use. For example, the user may actuate a locking segment ("not shown") to release the roller device from the second configuration. In an exemplary embodiment, the coupling mechanism can utilize springs to keep the structural pins engaged in the locked second position.

In an exemplary embodiment, the roller device is approximately a foot in length and six inches in diameter when locked in the second position. In some embodiments, a roller device can range from 1 to 3 feet in length. In some embodiments, the roller device is greater than or equal to 6 inches in diameter when in the second position. In one or more embodiments, the roller device can range from 2 inches to 5 feet.

Figure 3:
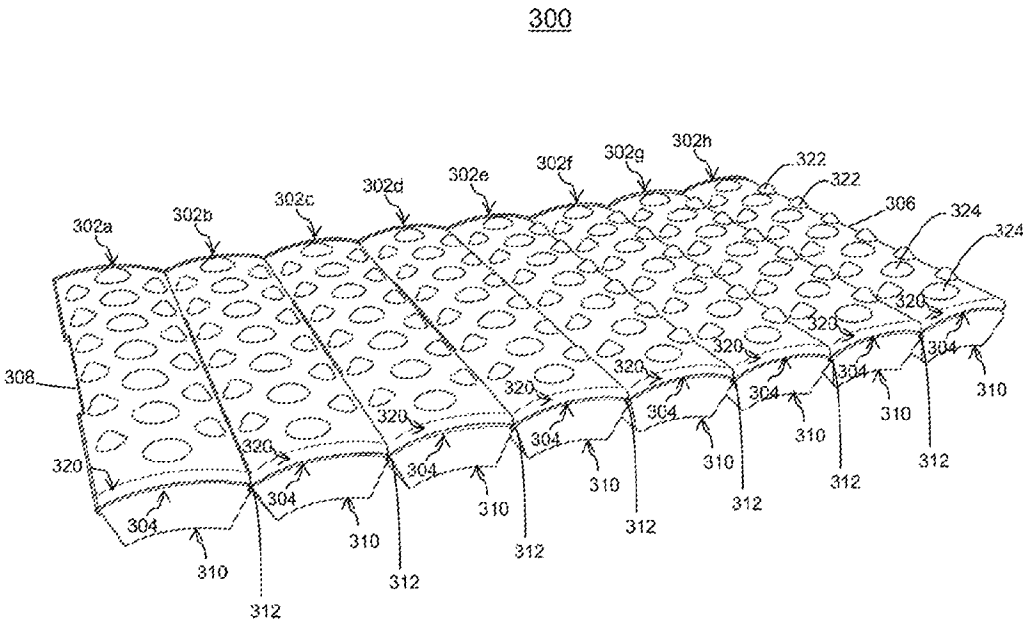
FIG. 3 illustrates another roller device according to an embodiment of the subject matter disclosed herein.

Now referring to FIG. 3, another exemplary embodiment of the roller device 300 is shown. The roller device 300 includes a plurality of segments 302*a*-302*h* in a first flat position. FIG. 3 illustrates each segment comprises a first edge 306 and a second edge 308 and further illustrates a coupling mechanism 312 for connecting the plurality of segments. Each segment 302 further includes an outer surface 304 and an inner surface 310. FIG. 3 further depicts a textured layer 320 that is applied to the outer surface 304. In an exemplary embodiment, the textured layer 320 exhibits a plurality of peaks, mounds, ridges, grooves, and the like. In an exemplary embodiment, the textured layer 320 as shown in FIG. 3 has two different shapes including peaks 322 and mounds 324. Each segment as shown as two rows of peaks 322 having six peaks per row and a row of mounds 324 between the two rows of peaks having seven mounds in the row. It would be known to one of ordinary skill in the art that any number of shapes and patterns can be applied to the textured layer 320 and various heights and densities of the features of the textured layer 320 can be selected based on the comfort level of the user. In addition various spacing between the features can be selected.

Figure 4:
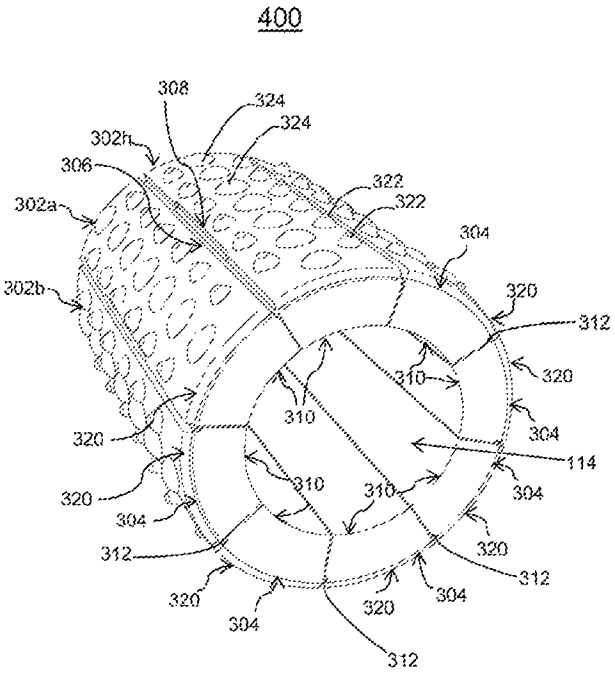
FIG. 4 illustrates an alternate view of the roller device of FIG. 3 according to an embodiment of the subject matter disclosed herein.

FIG. 4 illustrates a roller device of FIG. 3 in a second tubular position 400. The plurality of segments 302*a*-302*h* form a core or base layer of the roller device 300 is coupled by the coupling mechanism 312 and is positioned in a second tubular position. The inner surface 310 of each of the plurality of segments form an inner cavity 314. In an exemplary embodiment, the inner cavity is circular in shape. In some embodiments, the inner cavity can be other shapes, including but not limited to a tubular, cylindrical, or polygonal shape. FIG. 4 further depicts a textured layer 320 being attached to outer surface 304. In addition, the firmness of the outer surface 304 and textured layer 320 of the roller device 300 is dependent upon the material used for each of the plurality of segments 302 and textured layer 320. The plurality of segments 302 of the roller device may be composed of the same material or different materials may be used simultaneously that can provide various/alternating levels of comfort based on an individual's needs. Non-limiting examples of foam materials include EVA (ethylene vinyl acetate) foam, urethane foam, poly-urethane foam, EPS (expanded polystyrene) foam, polyethylene foam, neoprene foam, and the like. Additionally, the foam materials can comprise open cell and closed cell configurations. In an exemplary embodiment, the roller device may be used in conjunction with a cover where the cover may slide over the device. Similarly, the cover may be comprised of different textures/patterns and may have varying levels of firmness. A number of different types of materials can be used to provide the desired density. In some embodiments, a cover can allow the user to have one rolling device but have a plurality of different textures/firmness for added variety.

In an exemplary embodiment, the outer surface 304 of each of the plurality of segments can have an textured layer 320 affixed to the core layer formed by one segment or a plurality of segments 302, for example, that can provide different levels of treatment for the user. The affixed textured layer 320 may be attached to the core layer by an adhesive, slide on to the segment, or snap into position on the outer surface 304 of each segment. In an exemplary embodiment, the textured layer 320 is interchangeable.

Figure 5:
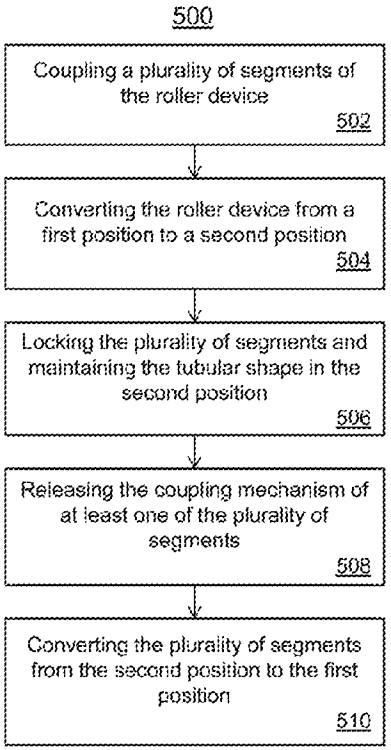
FIG. 5 illustrates a flow diagram of a method for converting a roller device according to an embodiment of the subject matter disclosed herein.

Now referring to FIG. 5, the method 500 depicts a technique for converting a portable roller device. As shown in block 502, the method 500 includes coupling a plurality of segment of the roller device. In an exemplary embodiment, the coupling of the plurality of segments can be accomplished by the coupling mechanisms including a hinge mechanism, Velcro attachments, zipper attachments, magnetic attachments, push-buttons, and the like. Block 504 shows converting the plurality of segments from a first position to a second position. In an exemplary embodiment the first position is a flat position where the plurality of segments lie parallel to one another in a horizontal plane and the second position is a tubular position. Block 506 provides locking the plurality of segments to secure and maintain the second position. As shown in block 508, the method 500 includes releasing the coupling mechanism of at least one of the plurality of segments. Block 510 provides converting the plurality of segments from the second position to the first position.

The roller device of the disclosure can be used for multiple purposes. In one embodiment, the roller device is used for exercise. In another embodiment, the roller device is used for correcting muscle imbalances. In other embodiments, the roller device is used for relieving muscle soreness and joint stress. An exemplary embodiment includes using the roller device to increase extensibility of musculotendinous junction. In another embodiment, the roller device is used to maintain normal function muscular length. In a further embodiment, the roller device is used for improving neuromuscular efficiency. In another embodiment, the roller device is used for home use for massage.

The roller device of the disclosure can have different types of coupling/interlocking mechanisms between the plurality of segments. Also the roller device can be composed of different materials types and include different sizes. The type of coupling mechanisms used can ensure the integrity and mobility of the roller device to facilitate portability. The type of material may be based on the firmness required by the user and the weight of the material to maximize portability.

Preferably, the materials used for the roller device can include a light weight material that is durable enough to withstand the force applied in massage or therapeutic applications. Various size roller devices may be selected based on the muscle groups the user intends to target during an exercise session.

In some embodiments, the disclosure provides a method for relieving muscle tension. The method includes applying the roller device of the disclosure to an area of a body and rolling the device across that area of the body. In some embodiments, the area of the body includes a leg. In some embodiments, the area of the body includes an arm. In other embodiments, the area of the body includes different muscle groups such the latissimus dorsi, hip flexors, trapezius, hamstrings, quadriceps, and the like.

Figure 6:
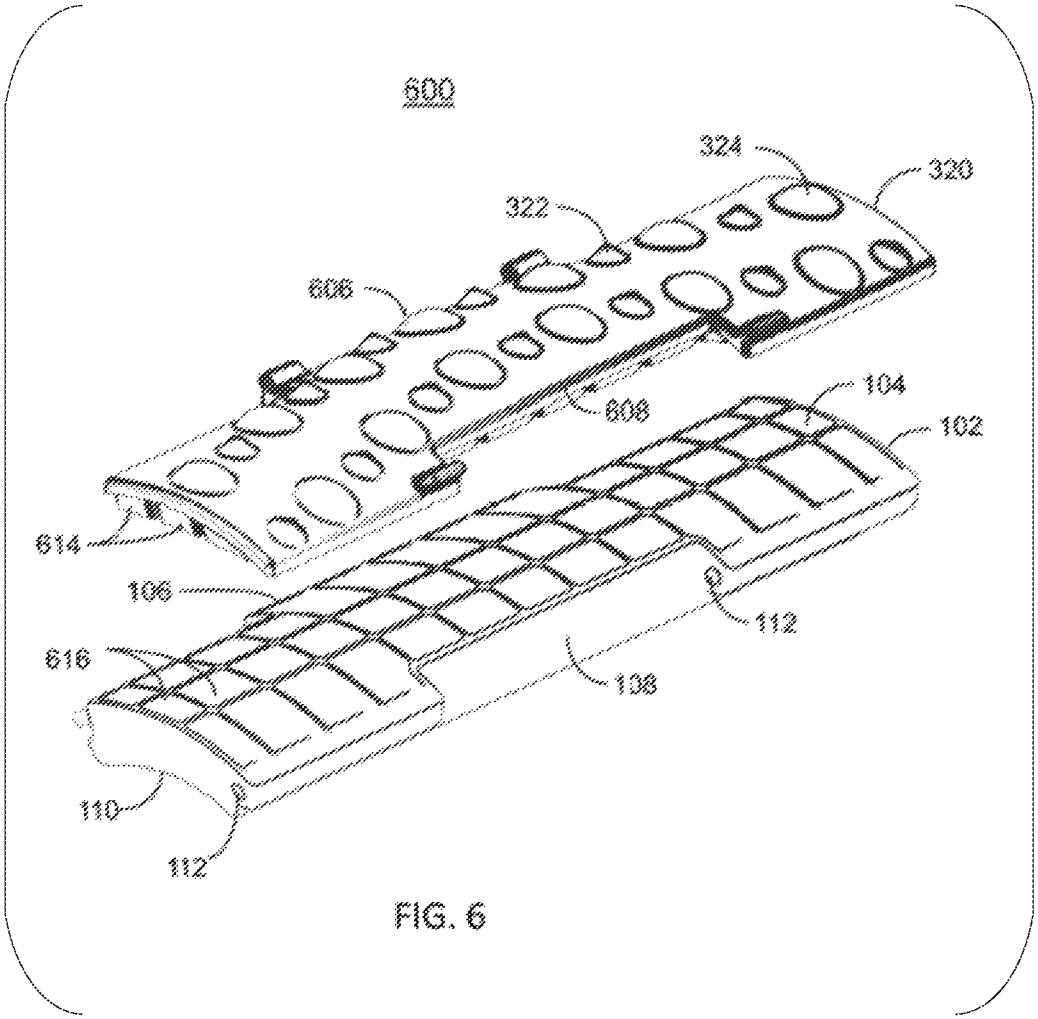
FIG. 6 illustrates a diagram of a segment and textured layer of a roller device according to an embodiment of the subject matter disclosed herein.

Now referring to FIG. 6, a diagram 600 provides cross-sectional view of a segment 102 and related textured layer 320 of the foam roller device in accordance with an embodiment. The textured layer 320 is similar to that shown in FIG. 3. The textured layer 320 can be affixed to the outer surface 104 of the segment 102. In one or more embodiments, the textured layer 320 can snap or slide into position on the outer surface 104 of the segment 102. The textured layer 320 includes a bottom structure 614. The bottom structure 614 can snap into the structure 616 on the outer surface 104 of segment 102. As shown, the textured layer 320 can have a plurality of peaks 322 and mounds 324. The pattern of the textured layer 320 depicted in FIG. 6 is a non-limiting example of patterns included in embodiments of the invention. In other embodiments, different patterns and configurations can be used are within the scope of the textured layer 320. Any pattern that can relieve muscle tension can be used. The segment 102 includes a female edge 108 and male edge 106 which can be coupled to their complementary edges (male and female, respectively) in neighboring segments 102. The textured layer 320 can include a textured layer male edge 606 and textured layer female edge 608. In some embodiments, the textured layer male edge 606 is positioned directly above male edge 106 and textured layer female edge 608 is positioned directly above female edge 108.

Figure 7:
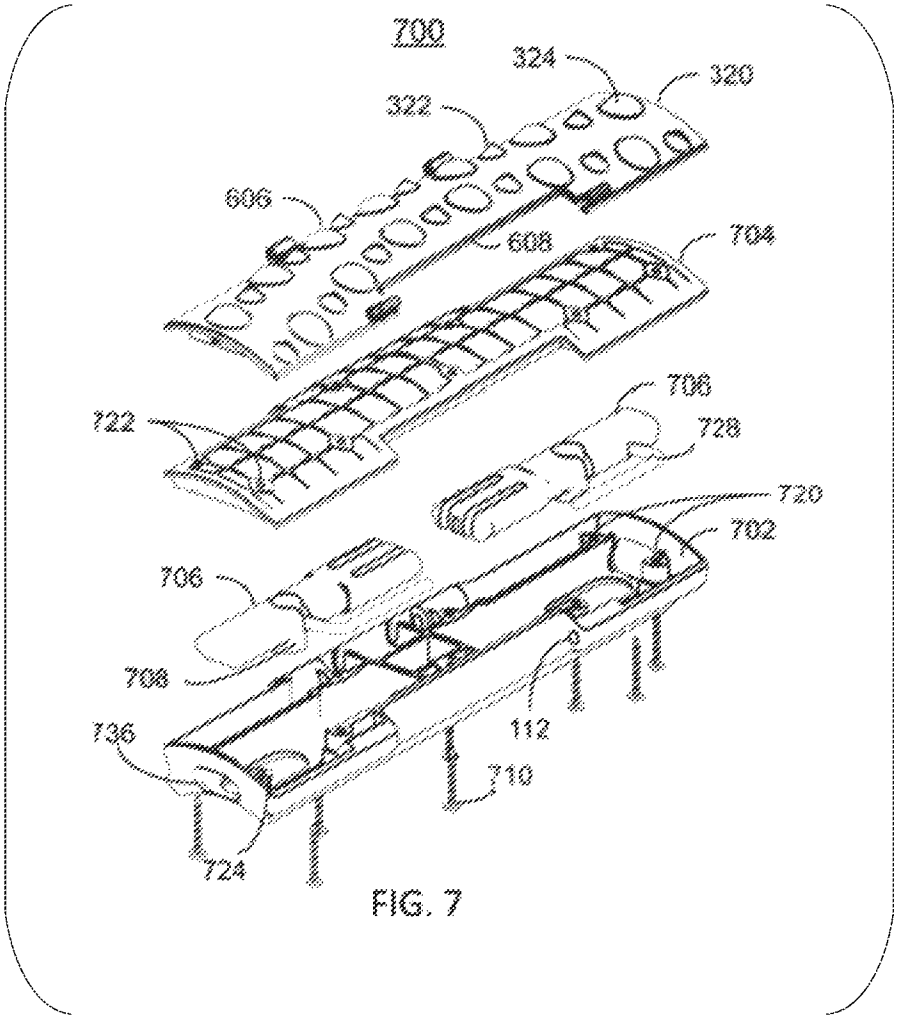
FIG. 7 illustrates a diagram of a locking mechanism of a roller device according to an embodiment of the subject matter disclosed herein.

In some embodiments, as noted previously a roller device can include a locking mechanism 706. FIG. 7 illustrates a cross-sectional side view of an exemplary locking segment 702 and locking mechanism 706 of a roller device in accordance with an embodiment. In one or more embodiments, the locking segment 702 includes an outer surface 704 having a textured layer 320 affixed to the outer surface 704. In one or more embodiments, the textured layer 320 is similar to the textured layer references above. The textured layer 320 includes a textured layer male edge 606 and textured layer female edge 608 to complement the outer surface 704. As shown in FIG. 7, the textured layer 320 can include a plurality of peaks 322 and mounds 324. In one or more embodiments, the outer surface 704 and the locking segment 702 can be secured together by a fastener or adhesive, such as a plurality of screws 710. The screws 710 can be screwed through the screw holes 720 of the locking segment 702 and the screw holes 722 of the outer surface 704. In a different embodiment, the outer surface 704 and locking segment 702 can be secured to one another by snapping or sliding into position. In other embodiments, these components can be held together by an adhesive or other known mechanism. The locking segment 702 can also include one or more locking mechanisms 706. The locking mechanism 706 as shown in FIG. 7 includes one or more locking pins 728. In this embodiment, the locking pin 728 comprises a non-linear shape, such as an angled shape or bent shape, wherein the portion of the locking pin 728 that may engage other segments is not necessarily in the same linear vector (e.g., the pin 728 is offset) as the locking mechanism 706. The locking pin 728 of locking segment 702 can secure adjacent segments 102 to one another by threading the locking pin 728 through the holes 112 of the locking segment 702. The locking mechanism 706 can be a bi-stable locking mechanism. A bi-stable locking mechanism is a locking mechanism that can be configured to be stable in either a locked or unlocked position where the locking mechanism can rest in one of the locked or unlocked positions due to the spring forces maintaining the positions. For example, in some embodiments, the locking mechanism 706 can be activated individually or in combination via other coupling techniques. The locking mechanism can be operated independently or with a coupling mechanism such as but not limited to a gear, belt or linkage system that can be used to synchronize the function of the locking mechanism together. In one or more embodiments, when one component of the locking mechanism is activated the other component can be activated directly without user intervention. A non-limiting set of examples of coupling means that allow combined activation includes gears, linkages, cables, and belt mechanisms. The locking mechanism 706 can be activated/released by the activate/release feature 708. Examples of the activate/release feature 708 include a sliding switch, push button, tab, latch mechanism, and the like. The activate/release feature 708 when assembled can be accessed through an opening 724 to allow a user to activate/release the locking segment 702 of the roller device. The side opening 736 of the locking segment 702 allows the locking mechanism 706 to slide in/out of the locking segment 702 when being activated/released.

In an example wherein the locking mechanism 706 includes a sliding mechanism, the sliding mechanism can be positioned in a fully locked position such that the roller device is held in a cylindrical configuration. The sliding mechanism can also be positioned in a fully unlocked position, such that the roller device can be converted from a cylindrical configuration to a configuration suitable for travel. The internal structure of locking segment 702 can include a sliding component or track component. In some embodiments, a sliding component or track component can include a spring. For example, a spring feature can be used as part of the locking mechanism 706 to revert the locking mechanism to a default locked or unlocked position. In an embodiment, a sliding component or track component can include an integral spring feature such as a spring composed of the same material or a spring molded as part of the sliding component or track component of the internal structure. In one or more embodiments, a spring feature can be used to bias the sliding component to either the lock position or the unlock position to manipulate the configuration of the roller device. The spring feature being coupled to the locking mechanism 706 can be compressed/decompressed to configure the bias position of the spring feature.

Figure 8:
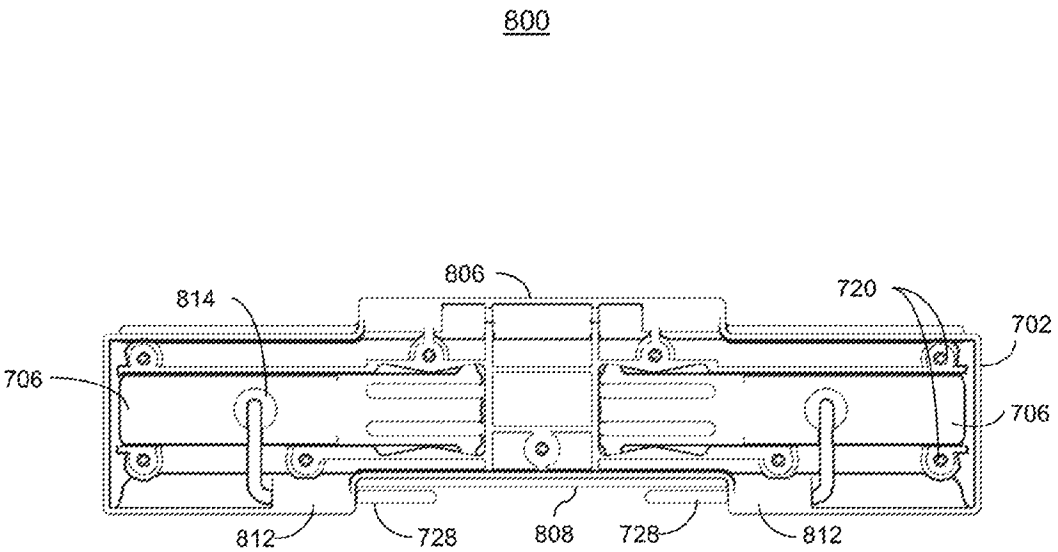
FIG. 8 illustrates a diagram of a locking mechanism of a roller device according to an embodiment of the subject matter disclosed herein.

Now referring to FIG. 8, a diagram 800 illustrating an internal view of the locking segment 702 and locking mechanism 706 of the roller device according to one or more embodiments of the present invention is shown. As is shown can the position of the locking mechanism 706 position within the locking segment 702 can be visible in some embodiments. The locking mechanism 706 can include a locking pin 728 that can be configured to be threaded through the locking segment hole 812 on the side of the locking segment 702 adjacent the female edge 808. In some embodiments, the locking pins 728 that are threaded through the holes 812 can be configured to be threaded through a neighboring segment's complementary locking segment male edge 806 to secure adjacent segments 102 together. As shown, the locking pins 728 can be affixed to the locking mechanism 706 by a connection 814. The locking segment 702 can include a plurality of screw holes 720 for attaching the bottom of locking segment 702 to an outer surface 704 (shown in FIG. 7). In one or more embodiments, different techniques can be used to attach the bottom portion of the locking segment 702 to the outer surface 704 such as adhesive or complimentary snap fit features.

Figure 9:
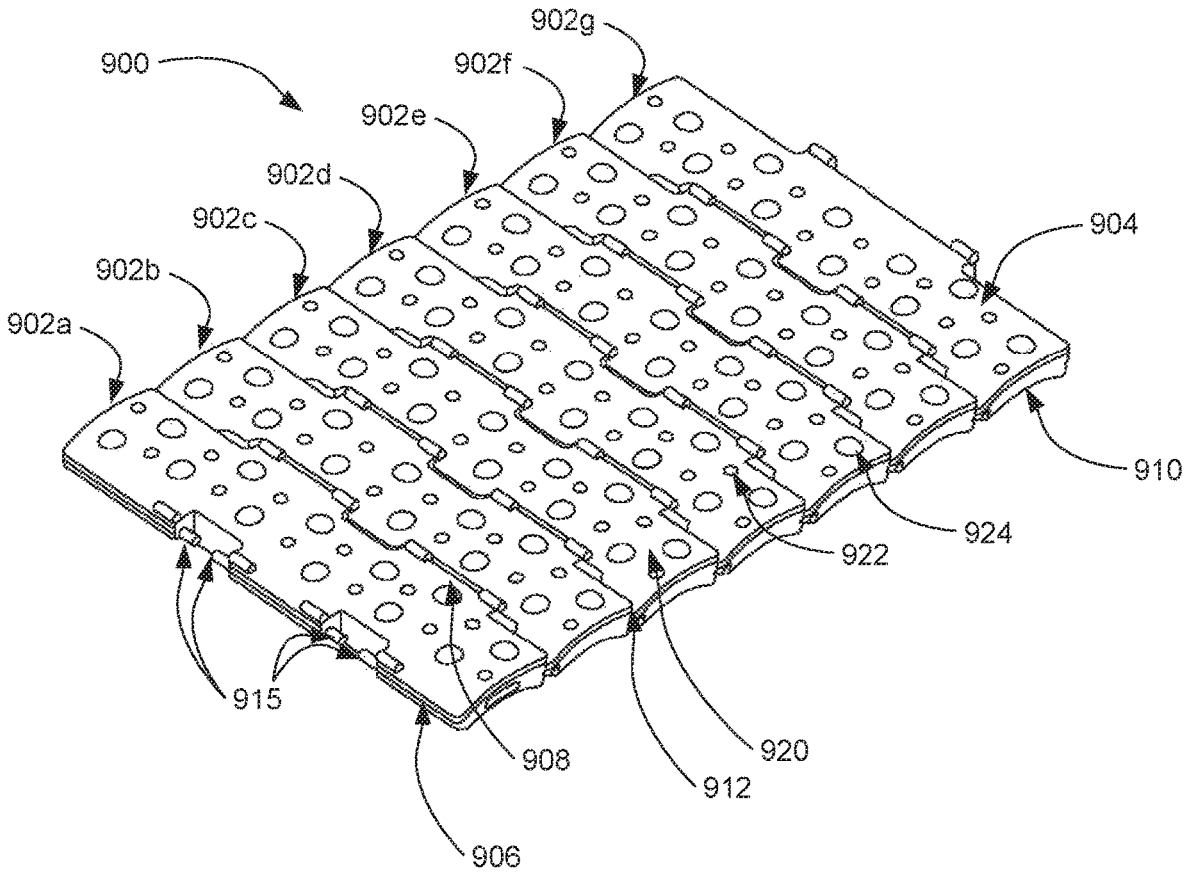
FIG. 9 illustrates another roller device according to an embodiment of the subject matter disclosed herein.

Turning attention to FIG. 9, a different embodiment of a roller device 900 is shown according to an embodiment of the subject matter disclosed herein. Similar to the embodiments described previously, The roller device 900 is shown in a first flat position. In the first flat position, the plurality of segments lie connected to one another in a parallel fashion in a horizontal plane. In some embodiments, the roller device is rectangular in shape when in a first flat position. As a non-limiting example, the rectangle can have a width W of 5 to 40 inches, or 5 to 30 inches, or 10 to 30 inches, or 10 to 20 inches, or 10 to 15 inches, or 14 inches. In some embodiments, the rectangle can have a length L of 5 to 40 inches, or 5 to 30 inches, or 10 to 30 inches, or 10 to 20 inches, or 10 to 15 inches, or 11.5 inches, and a thickness or height of 0.5 to 3 inches, or 1 to 3 inches, or 1 to 2 inches, or 1.7 inches. The first flat position can be convenient for storage and/or transportation of the device. In another embodiment, the roller device can be formed by a single flexible, semi-rigid material. The roller device can include a plurality of segments numbered, 902*a*, 902*b* . . . 902*g* forming a core layer or base layer of the device, where each of the plurality of segments has an inner surface 910 and an outer surface 904, and where n represents the total number of segments in the device and is an integer from 1 to 100. In an embodiment, the outer surface 904 can have a flat or curved surface and the inner surface 910 can have a flat or curved surface.

In a non-limiting example, FIG. 9 depicts an exemplary roller device 900 having 8 segments. In some embodiments, the roller device has from 5 to 50 segments, such as 5 to 20 segments, or from 5 to 10 segments. As commonly shown, the device 900 has from 5 to 10 segments. The outer surface 904 of each segment 902 provides a surface that makes contact with a user's muscles or target area during use. In an exemplary embodiment, the outer surface 904 as shown in FIG. 9 can have a smooth surface. In another embodiment, the outer surface 904 can have a textured/patterned surface. Additionally, the outer surface 904 may have various densities which may be selected according to a selected level of treatment, comfort, or therapy. The plurality of segments 902 can be composed of a low-density material, medium density material, high density material or any combination thereof offering various resistances to the user. The low-density materials can provide a softer surface for the user and the high-density materials can provide a firmer surface.

The medium-density material can be a compromise between the low and high density options. Non-limiting examples of foam materials include EVA (ethylene vinyl acetate) foam, urethane foam, poly-urethane foam, EPS (expanded polystyrene) foam, polyethylene foam, neoprene foam, and the like. Additionally, the foam materials can comprise open cell and closed cell configurations.

Each of the plurality of segments 902 include a first edge 906 and a second edge 908 where the first edge 906 is located opposite the second edge 908. FIG. 9 depicts the first edge 906 of segment 902*b* can be coupled to a second edge 908 of a first neighboring segment 902*a* and the second edge of 902*b* can be coupled to a first edge 906 of a second neighboring segment 902*c*. Similarly, the first edge 906 and second edge 908 of segment 902*d* can be coupled to the second edge 908 of segment 902*c* and the first edge 906 of segment 902*e* respectively. In some embodiments, the first edge of a segment can complement the second edge of a neighboring segment allowing the plurality of segments to be coupled to one another and form the roller device. Complementary edges of neighboring segments are configured to be inserted into one another, such that one set of protrusions on a one edge of a first segment is configured to interface with an opposite and complementary set of protrusions on a neighboring segment.

FIG. 9 further depicts each of segments 902*a*-902*g* coupled to neighboring segments where each of the plurality of segments 902*a*-902*g* are coupled to the neighboring segments at a distal edge 912, where the distal edge 912 is located on the outer surface 904. A coupling mechanism can be any mechanism that joins the neighboring segments in a manner that allows the segments to move relative to one another. In this exemplary embodiment the coupling mechanism is a hinge device secured by two or more structural pins 915 between interlocking protrusions. The coupling mechanism can allow the plurality of segments 902*a*-902*g* to maintain their ability to pivot around the coupling mechanism and convert between a first flat position and a second tubular position (shown in FIG. 10).

In this exemplary embodiment, the roller device 900, as shown in FIG. 9 includes the coupling mechanism 112 having four structural pins 915 in combination with a first edge 906 of a segment coupled to a second edge 908 of a neighboring segment having pin receptacles (not shown in FIG. 9), where the structural pins 915 are threaded through the receptacle portions (shown as 916 in FIG. 11) of the second edge 908. This exemplary configuration can allow the plurality of segments to be secured to one another during compressive force or pivot and separate with an outward radial force when the coupling mechanism is released.

FIG. 9 further depicts a textured layer 920 that is disposed on the outer surface 904. In this exemplary embodiment, the textured layer 920 exhibits a plurality of peaks, mounds, ridges, grooves, and the like. In an exemplary embodiment, the textured layer 920 as shown in FIG. 9 has two different sizes of peaks: large peaks 924 and small peaks 922. Each segment as shown as wave pattern of small and large peaks such that each segment includes having twelve large peaks 924 and twelve small peaks 922 interspersed with each other in a curvilinear pattern as shown. It would be known to one of ordinary skill in the art that any number of shapes and patterns can be applied to the textured layer 920 and various heights and densities of the features of the textured layer 920 can be selected based on the comfort level of the user. In addition various spacing between the features can be selected.

Figure 10:
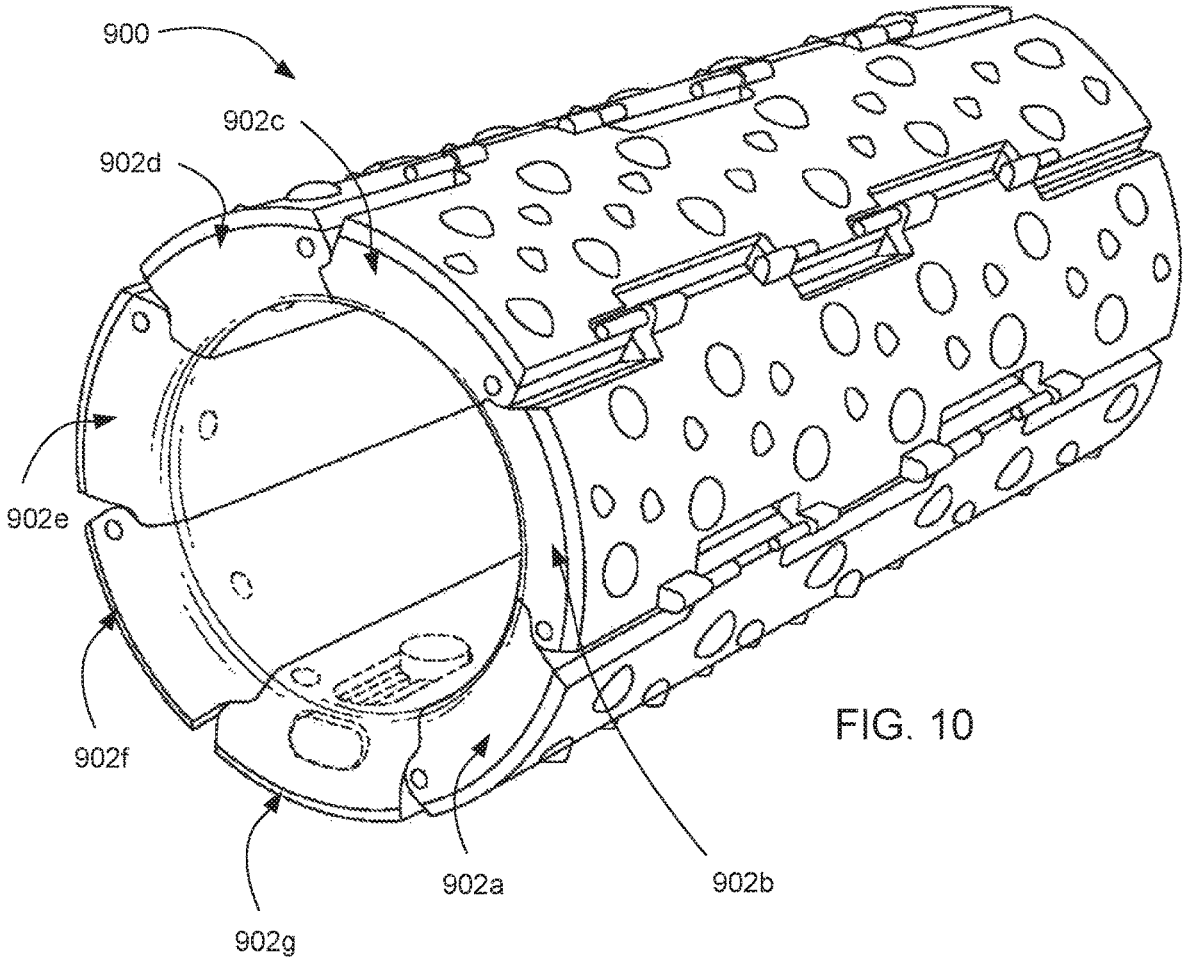
FIG. 10 illustrates an alternate view of the roller device of FIG. 9 according to an embodiment of the subject matter disclosed herein.

FIG. 10 illustrates a second configuration of the roller device 900 of FIG. 9, where the plurality of segments 902*a*-902*g* can be connected to form a tubular shape. Each of the plurality of segments 902*a*-902*g* can be secured by the coupling mechanisms joining a first edge 906 of each segment 902*a*-902*g* to a second edge 908 of a neighboring segment. The second configuration is formed when the plurality of segments 902*a*-902*g* is coupled and the first segment 902*a* and last segment 902*g* of the plurality of segments are connected forming a rigid tubular structure. The plurality of segments 902*a*-902*g* form an inner cavity when in the second configuration. In a different embodiment, a single flexible, semi-rigid material having a coupling mechanism can be converted into the second configuration and form an inner cavity. In an exemplary embodiment, the inner cavity can be tubular, cylindrical, or polygonal in shape. The coupling mechanism can allow each of the plurality of segments to pivot around the coupling mechanism to convert from a first flat position shown in FIG. 9 to the second tubular shape position as shown in FIG. 10. When the exercise or therapy session is completed at least one of the plurality of segments 902*a*-902*g* can be disconnected and the roller device 900 can be returned to the first position shown in FIG. 9 for storage/transport. In an exemplary embodiment, the user can engage and disengage the coupling mechanism to convert the roller device 900 from a first configuration for storage to the second configuration for use. For example, the user may actuate a locking segment ("not shown") to release the roller device 900 from the second configuration. In an exemplary embodiment, the coupling mechanism can utilize springs to keep the structural pins engaged in the locked second position.

Figure 11:
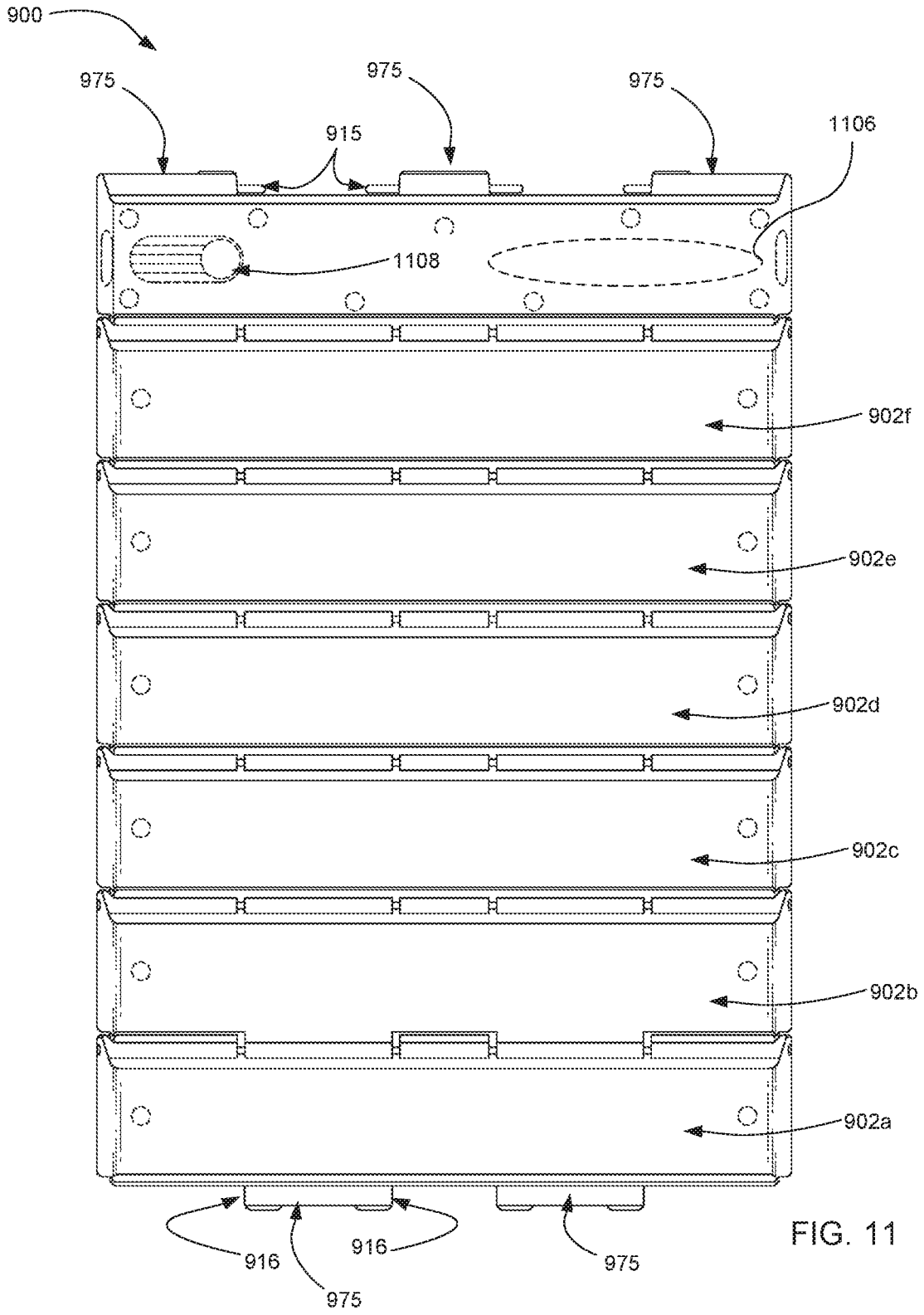
FIG. 11 illustrates an alternate view of the roller device of FIG. 9 according to an embodiment of the subject matter disclosed herein.

FIG. 11 illustrates an alternate view of the roller device 900 of FIG. 9 according to an embodiment of the subject matter disclosed herein. In this view, one can see the interior surface of the roller device 900 in the flat position with the inner portions of each segment 902*a*-*g* being shown. Each segment is shown with protrusions 975 emanating from the distal edge of each segment and interlocking with at least one neighboring segment's respective protrusions. For example, segment 902*a* is shown with two protrusions 975 emanating down from the segment (down is relative and designated with respect to FIG. 11 as an example) and similarly, segment 902*g* is shown with three protrusions emanating upward from the segment 902*g*. The protrusions emanating down from the segment 902*a* have receptacles for receiving pins from a neighboring segment; specifically these receptacles 916 may receive the pins 915 of the protrusions 975 emanating from the segment 902*g*. In this manner, each segment includes a plurality of protrusions configured to interface with a plurality of a neighboring segment's protrusions.

As before as described above with respect to FIG. 7, the roller device 900 can include a locking and unlocking mechanism that can be actuated through actuation of button 1106. The locking mechanism 1106 (represented by a dotted ellipse as shown in FIG. 11) includes the functionality of retracting or extending one or more locking pins 915. The locking pins 915 of locking segment 902*g* can secure an adjacent segment (e.g., segment 902*a*) to one another by threading the locking pins 915 through the receptacles 916 of the corresponding locking segment 902*a*. The locking mechanism 1106, in this embodiment, can be a bi-stable locking mechanism. For example, in some embodiments, the locking mechanism 1106 can be activated individually or in combination via a coupling means. A non-limiting set of examples of coupling means that allow combined activation includes gears, linkages, cables, and belt mechanisms. The locking mechanism 1106 can be activated/released by the feature 1108. Examples of the feature 1108 include a sliding switch, push button, tab, latch mechanism, and the like.

In an exemplary embodiment, the roller device is approximately a foot in length and six inches in diameter when locked in the second position. In some embodiments, a roller device can range from 1 to 3 feet in length. In some embodiments, the roller device is greater than or equal to 6 inches in diameter when in the second position. In one or more embodiments, the roller device can range from 2 inches to 5 feet.

Figure 12:
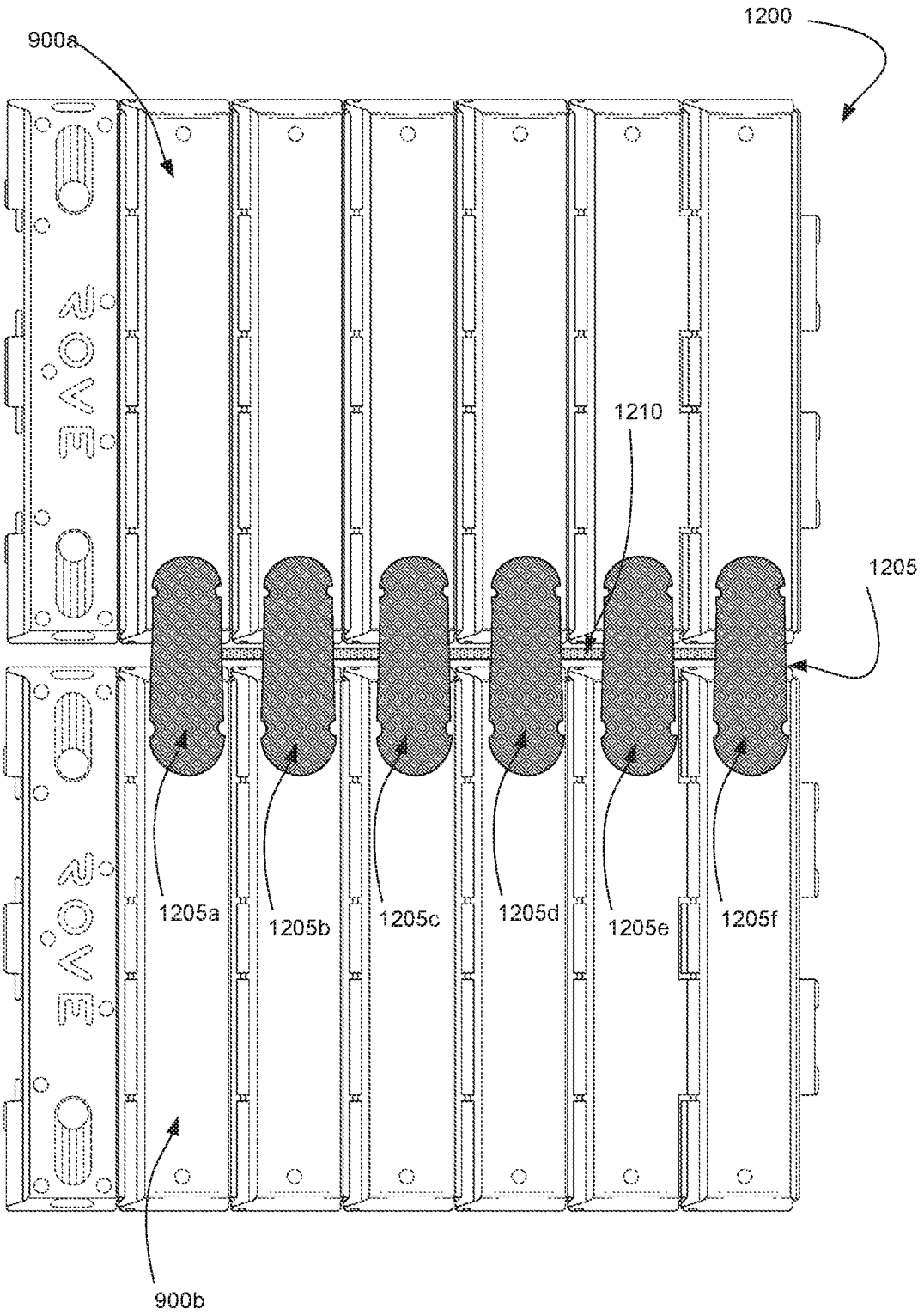
FIG. 12 illustrates an embodiment of the roller device wherein two or more roller devices are linked together by a linkage to form a larger roller device.

FIG. 12 illustrates an embodiment of a linked roller device 1200 wherein two or more roller devices 900 are linked together by a linkage member 1205 to form a larger linked roller device 1200. In this embodiment, two roller devices 900 (as shown in previous figures) may further includes receptacles on one or both ends of each segment that may receive a linkage member 1205 for linking a first roller device 900*a* with a second roller device 900*b*. These receptacles are not shown in FIG. 12 as the linkage member 1205 is engaged with each receptacle in a manner that obscures the view of the receptacles. However, a skilled artisan understands that the receptacles may have a contour that matches the contour of an end of one of the linkage member protrusions 1205*a*-1205*f* so as to securely engage the linkage member 1205 to create a larger roller device 1200 from two separate smaller roller devices 900*a* and 900*b*. As such, when engaged with a receptacle each linkage member protrusion 1205*a*-1205*f*.

The linkage member protrusions are secured together with a flexible linkage member 1210 that allows for lateral movement of each linkage member protrusion 1205*a*-1205*f* so that ease of assembly and limited flexibility of the overall larger roller device may be achieved. The linkage member 1205 may be made from similar materials as described previously with respect to the roller device 900. Further, the linkage member 1205 is shown with six protrusions 1205*a*-1205*f* however, other embodiments may include more or fewer protrusions While the subject matter discussed herein is susceptible to various modifications and alternative constructions, certain illustrated embodiments thereof are shown in the drawings and have been described above in detail. It should be understood, however, that there is no intention to limit the claims to the specific forms disclosed, but on the contrary, the intention is to cover all modifications, alternative constructions, and equivalents falling within the spirit and scope of the claims.

What is claimed is:

1. A roller device, comprising:

a core layer having a plurality of segments that are each respectively coupled to at least one other segment in the plurality of segments, the coupled segments forming the core layer having an outer surface and an inner surface;

wherein each segment of the plurality of segments further comprises a plurality of interlocking protrusions disposed on a side facing an adjacent segment, the plurality of interlocking protrusions configured to interface with at least one other plurality of interlocking protrusions of the adjacent segment of the plurality of segments;

wherein the core layer forms a tubular inner cavity free from any structure in the tubular cavity, the tubular inner cavity adjacent to the inner surface of the core layer; and wherein at least one segment of the plurality of segments further comprises a coupling mechanism having a releasable angular locking pin actuated by a pushbutton configured to engage and disengage an adjacent segment on the plurality of segments.

2. The roller device of claim 1, wherein the plurality of interlocking protrusions further comprises two interlocking protrusions.

3. The roller device of claim 1, further comprising a tubular inner cavity formed by the inner surface of the core layer.

4. The roller device of claim 1, wherein each segment of the plurality of segments comprises a curved portion.

5. The roller device of claim 1, wherein the outer surface is textured.

6. The roller device of claim 1, wherein each protrusion on a first edge of each segment comprises at least one angular locking pin and each protrusion on a second edge of each segment comprises at least one angular locking pin receptacle.

7. A massage therapy device, comprising:

a plurality of segments, each segment comprising:

a body portion of a roller having a first edge and a second opposite edge;

a first plurality of protrusions emanating from the first edge; and a second plurality of protrusions emanating from the second edge, the second plurality of protrusions a complement of the first plurality of protrusions;

wherein each of the plurality of segments is rotatably coupled to at least one other adjacent segment of the plurality of segments forming a tubular inner cavity free from any structure in the tubular cavity; and wherein at least one segment of the plurality of segments further comprises a coupling mechanism having a releasable angular locking pin actuated by a pushbutton configured to engage and disengage an adjacent segment on the plurality of segments.

8. The massage therapy device of claim 7, wherein each segment further comprises a detachable skin having a pattern of peaks configured to deliver massage therapy.

* * * * *